US005917161A

United States Patent [19]

Fuhrmann

[11] Patent Number: 5,917,161

[45] Date of Patent: Jun. 29, 1999

[54] MUFFLER WITH VARIABLE DAMPING CHARACTERISTICS

[75] Inventor: Bernd Fuhrmann, Neustadt, Germany

[73] Assignee: Heinrich Gillet GmbH & Co., KG, Edenkoben, Germany

[21] Appl. No.: 08/896,921

[22] Filed: Jul. 18, 1997

[30] Foreign Application Priority Data

Jul. 20, 1996 [DE] Germany ..... 196 29 367

[51] Int. Cl.[6] ..... F01N 1/00

[52] U.S. Cl. ..... 181/237; 181/254; 181/265; 181/272

[58] Field of Search ..... 181/237, 241, 181/253, 254, 265, 266, 269, 272, 278

[56] References Cited

U.S. PATENT DOCUMENTS 3,620,330 11/1971 Hall ..... 181/237
4,484,659 11/1984 Buchwalder ..... 181/237
4,903,486 2/1990 Finkle ..... 181/237
5,435,347 7/1995 Gillingham ..... 181/237

FOREIGN PATENT DOCUMENTS 89 08 244 10/1989 Germany .
778 033 7/1957 United Kingdom .

*Primary Examiner*—Khanh Dang
*Attorney, Agent, or Firm*—Cohen, Pontani, Lieberman & Pavane

[57] ABSTRACT

A muffler having a movable valve disk, with the help of which at least one of the tubes in the muffler housing can be opened and closed. The actuation organ for the valve disk is a corrugated tube, the fixed end of which is placed into an opening in the housing and the interior of which is connected to the atmosphere. As a result, the total pressure loss of the muffler is available as an actuation force.

14 Claims, 2 Drawing Sheets

MUFFLER WITH VARIABLE DAMPING CHARACTERISTICS

BACKGROUND OF THE INVENTION

1. Field of the Invention

The invention relates to a muffler with a variable damping characteristic for pulsating gases.

2. Description of the Prior Art

German reference DE U 89 08 244 discloses an exhaust gas muffler with more than one outlet tube. One of the outlet tubes can be opened and closed by means of a valve. The corrugated tube is located in the interior of the muffler housing. The interior of the corrugated tube is connected to the inlet tube of the muffler via a pressure line. If pressure increases in the inlet tube of the muffler as motor speed rises, the corrugated tube becomes longer. To use this elongation for the purpose of opening the valve, a relatively complicated mechanical system is needed. Moreover, the differential pressure between the inlet tube of the muffler and the interior of the muffler housing is relatively slight, so that corrugated tubes with a large cross-section are needed to produce the required forces.

It is also disadvantageous that sealing an end tube in the manner disclosed in DE U 89 08 244 results in the creation of high-frequency noises due to the increased gas speed in the unsealed end tube. Such designs are therefore unanimously rejected by experts.

SUMMARY OF THE INVENTION

The object of the present invention is to provide a muffler of the aforementioned type with a variable damping characteristic that is extremely simple and reliable and has optimal acoustics.

Pursuant to this object, and others which will become apparent hereafter, one aspect of the present invention resides in a muffler with variable damping characteristics for pulsating gases, which muffler is comprised of a housing, a gas supply tube arranged to pass into the housing, tubes integrated in the housing and in fluid communication with the gas supply tube, at least one valve disk operatively arranged to open and close at least one of the tubes, the valve disk having a rest position in which it seals one of the gas supply tube and one of the integrated tubes connected to the supply tube, at least one actuation organ configured as a corrugated tube arranged in the housing, the corrugated tube having a fixed end attached to the housing and a movable end connected to the valve disk so as to move the valve disk, a gas discharge tube arranged to pass out of the housing and in fluid communication with the integrated tubes, and a source of reduced pressure connected to an interior of the corrugated tube.

A substantial advantage of the present invention is its minimal number of movable parts. The actuation force is maximum, because use is made of the total pressure differential between the housing and the atmosphere. Complicated deflections are unnecessary, because the corrugated tube shortens as internal pressure rises in the housing.

Corrugated tubes are commercially available in all desired sizes and requisite qualities. These tubes can withstand the temperatures that occur in exhaust gas mufflers without problems. Because of the high actuation forces, corrugated tubes with small cross-sections are adequate.

Preferably, the source of reduced pressure is the free atmosphere, since it is available at all times. An alternative source is the intake tract of the motor, the pressure of which is lower than the atmospheric pressure.

Advantageously, the fixed end of the corrugated tube is placed into an opening in the housing. As a result, no special pressure tube to the atmosphere is needed.

According to another embodiment of the invention, an interior support tube supports the corrugated tube. Alternatively, an external support tube can be used to support and protect the corrugated tube. In either case, thanks to the support tube, it is possible to use long and/or soft corrugated tubes, so that even large valve strokes can be realized.

The form of the valve disk can vary within wide limits. For example, the gas flow can be directed onto particular paths. In particular, however, it is possible to influence the dependency between the stroke and the gap cross-section.

In a further embodiment of the invention, a guide tube is located between the corrugated tube and the valve disk, and a wire cushion, which serves as a slide bearing, is located between the support tube and the guide tube. These measures also serve to increase the mechanical strength.

Preferably, a cup-shaped bottom seals the fixed end of the corrugated tube. The bottom has an opening via which the interior of the corrugated tube is connected to the atmosphere.

As mentioned above, long and/or soft corrugated tubes are suitable for achieving large valve strokes. If it becomes necessary to increase the spring constant of the corrugated tube, an additional spring can be used. Depending on the desired spring characteristic, this may be a cylindrical helical spring, a conical coil spring, etc. Preferably, the spring is located between the interior support tube and the valve disk. Alternatively, it is also possible to position the spring between the fixed end and the movable end of the corrugated tube.

Finally, it is possible to move more than one valve disk with a single corrugated tube or to use multiple corrugated tubes, preferably with different response characteristics, for the purpose of achieving a multi-step change in the acoustics.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
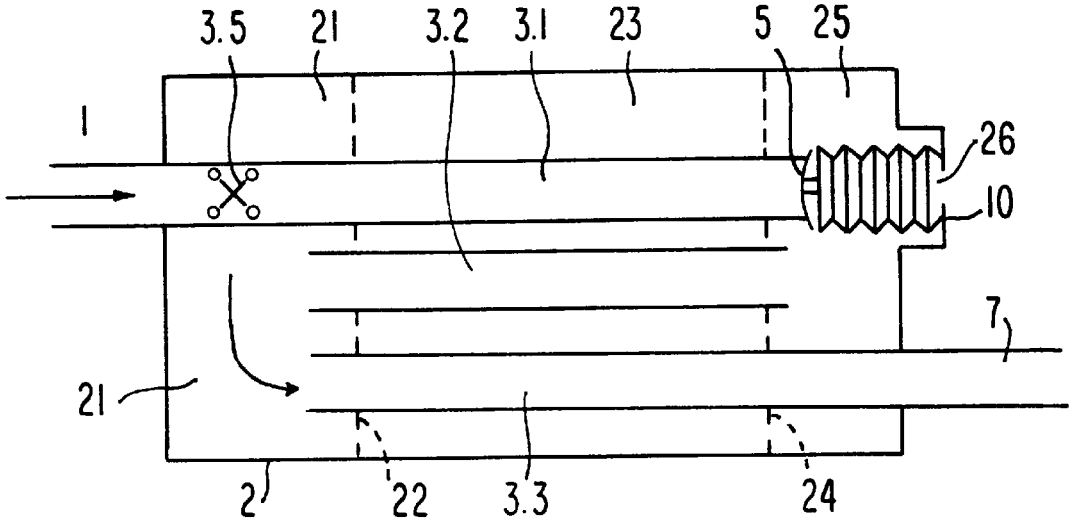
FIG. 1 is a longitudinal section through an exhaust gas muffler at low mass flow, shown in purely schematic fashion.

In purely schematic fashion, FIG. 1 shows a longitudinal section through an exhaust gas muffler for internal combustion engines. A gas supply tube 1 ends in a muffler housing 2, in which three muffler tubes 3.1, 3.2, 3.3, for example, are integrated. A gas discharge tube 7 carries the gas out of the housing 2.

The end of tube 3.1 that is connected to the gas supply tube 1 can be sealed by means of a valve disk 5. The valve disk 5 is activated with the help of a corrugated tube 10, the movable end of which is sealed in a gas-tight manner and carries the valve disk 5. The fixed end of the corrugated tube 10 is placed into an opening of the muffler housing 2 in a gas-tight fashion, so that the interior of the corrugated tube 10 is directly connected to the atmosphere via an opening 26. For this reason, no separate pressure tube from the corrugated tube 10 to the atmosphere is needed.

The interior of the housing 2 is divided into three chambers 21, 23, 25 by two perforated walls 22, 24. All three chambers 21, 23, 25 are designed as expansion chambers. The exhaust tube 3.2, with a reduced cross-section, penetrates the walls 22, 24 parallel to the tube 3.1, which can be sealed by the valve disk 5.

When, as shown in FIG. 1, the tube 3.1 is sealed by the valve disk 5 as the result of a small pressure differential between the housing 2 and the atmosphere, the exhaust gas flows through a perforation 3.5 into the expansion chamber 21. From there, the exhaust gas enters the tube 3.3 and then leaves the muffler housing 2 via the end tube 7.

Figure 2:
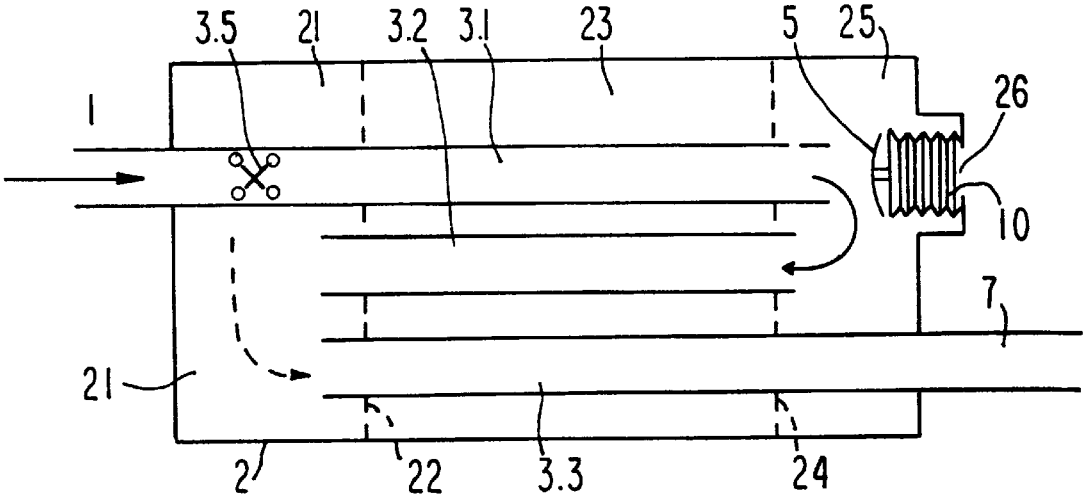
FIG. 2 shows the muffler of FIG. 1 at high mass flow.

When, as shown in FIG. 2, the valve disk 5 is open due to a large pressure differential between the housing 2 and the atmosphere, the exhaust gas flows through the tube 3.1 into the third chamber 25 and through the tube 3.2 into the first chamber 21. The exhaust gas then leaves the muffler housing 2, once again via the tube 3.3 and the end tube 7.

Figure 3:
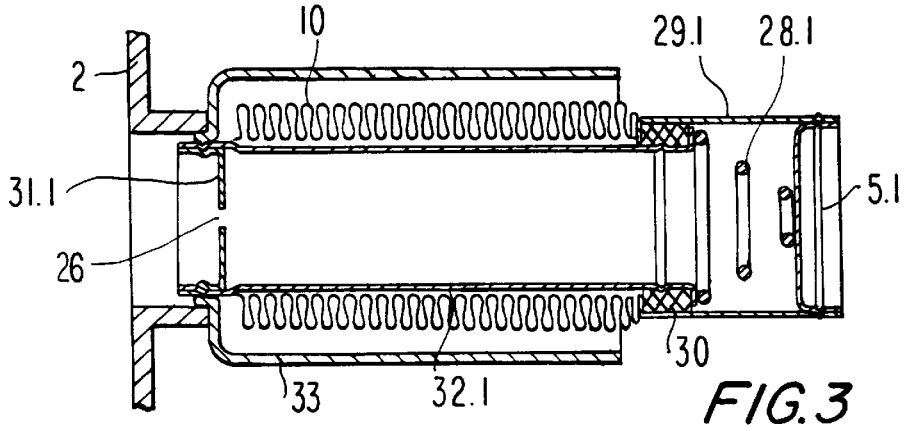
FIG. 3 is a longitudinal section through a first embodiment of the corrugated tube.

FIG. 3 shows an enlarged view of a longitudinal section through a first embodiment of the tube 10. The corrugated tube 10 has been placed into an opening of the muffler housing 2. The fixed end of the corrugated tube 10 is welded in a gas-tight manner to an interior support tube 32.1, which has a cup-shaped bottom 31.1. The opening 26 to the atmosphere is located in the bottom 31.1. An outer support tube 33 surrounds the corrugated tube 10 and protects it from damage.

A guide tube 29.1 is placed upon the movable end of the corrugated tube 10. A sealing lid 5.1 seals the free end of the guide tube 29.1 in a gas-tight manner.

A wire cushion 30, or an element that acts similarly thereto, is placed onto the end of the interior guide tube 32.1 to serve as a slide bearing for the guide tube 29.1. Between the interior support tube 32.1 and the sealing lid 5.1, there is a conical coil spring 28.1, with the help of which the spring constant of the corrugated tube 10 can be changed.

Figure 4:
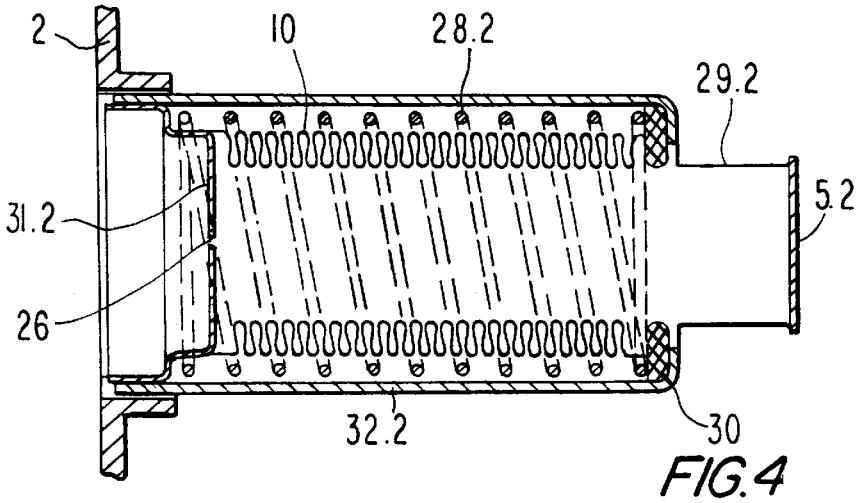
FIG. 4 is a longitudinal section through a second embodiment of the corrugated tube.

FIG. 4 shows a second embodiment in which an exterior support tube 33.2 is provided, which also performs the function of a protective tube. The wire cushion 30 is connected to the corrugated tube 10 or to a guide tube 29.2. The free end of the guide tube 29.2 is sealed by a flat lid 5.2. A cylindrical helical spring 28.2 for changing the spring constant of the corrugated tube 10 is positioned between the cup-shaped bottom 31.2 and the wire cushion 30 or the movable end of the corrugated tube 10.

Figure 5:
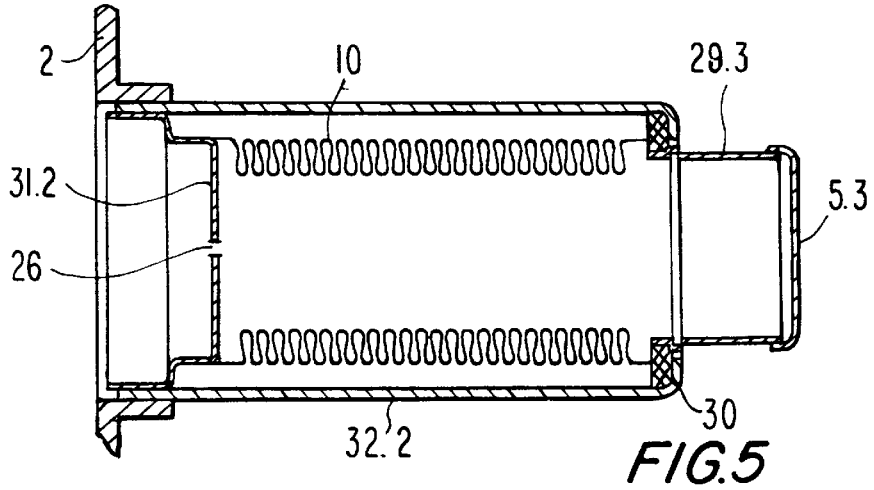
FIG. 5 is a longitudinal section through a third embodiment of the corrugated tube.

FIG. 5 shows a third embodiment, which corresponds substantially to the embodiment in FIG. 4. In this case, however, the free end of the guide tube 29.3 is sealed by a pot-shaped lid 5.3.

In the embodiments shown in FIGS. 3, 4 and 5, it is possible to simply use the depicted lids 5.1, 5.2, 5.3 as the valve disk 5. However, other valve disks 5 can also be used.

Of course, not only a single muffler tube can be opened and sealed in a muffler housing by means of a valve disk and a corrugated tube. Rather, using multiple valve disks and corrugated tubes, it is also possible to open and seal multiple muffler tubes. It is advisable, for the purpose of attaining a multi-step acoustical adjustment, to design the corrugated tubes to have different response characteristics.

The invention is not limited by the embodiments described above which are presented as examples only but can be modified in various ways within the scope of protection defined by the appended patent claims.

I claim:

1. A muffler with variable damping characteristic for pulsating gases, consisting essentially of:

a housing;

a gas inlet tube arranged to pass into the housing;

a plurality of tubes arranged in the housing so as to be in fluid communication with the gas inlet tube, one of the tubes being directly connected to the gas inlet tube;

a valve disk movably arranged to open and close one of the gas inlet tube and the tube connected to the gas inlet tube, the valve disk having a rest position in which the one of the gas inlet tube and the tube connected to the gas inlet tube is sealed;

a corrugated tube having a fixed end attached to the housing, and a movable end connected to the valve disk so as to move the valve disk;

a gas discharge tube arranged to pass out of the housing and in fluid communication with the plurality of tubes; and a source of reduced pressure connected to an interior of the corrugated tube so that control pressure for opening and closing of the valve disk is only provided by gas passing through the tubes.

2. A muffler as defined in claim 1, wherein the source of reduced pressure is the atmosphere.

3. A muffler as defined in claim 1, wherein the housing has an opening, the fixed end of the corrugated tube being placed directly into the opening of the housing.

4. A muffler as defined in claim 1, and further comprising an interior support tube arranged within the corrugated tube so as to support the corrugated tube.

5. A muffler as defined in claim 1, and further comprising an external support tube arranged around the corrugated tube so as to support and protect the corrugated tube.

6. A muffler as defined in claim 1, wherein the valve disk is configured as a flow guidance element.

7. A muffler as defined in claim 4, and further comprising a guide tube located between the corrugated tube and the valve disk, and a wire cushion located between the support tube and the guide tube.

8. A muffler as defined in claim 1, and further comprising a cup-shaped bottom member arranged to seal the fixed end of the corrugated tube, the bottom member having a through-opening.

9. A muffler as defined in claim 1, wherein the corrugated tube has a spring constant, and further comprising spring means for increasing the spring constant of the corrugated tube.

10. A muffler as defined in claim 4, wherein the corrugated tube has a spring constant, and further comprising spring means for increasing the spring constant of the corrugated tube.

11. A muffler as defined in claim 10, wherein the spring means includes a spring positioned between the interior support tube and the valve disk.

12. A muffler as defined in claim 9, wherein the spring means is positioned between the fixed end and the movable end of the corrugated tube.

13. A muffler as defined in claim 1, and further comprising a plurality of corrugated tubes with different response characteristics, and a plurality of valve disks arranged to respectively seal different ones of the tubes.

14. A muffler as defined in claim 5, and further comprising a guide tube located between the corrugated tube and the valve disk, and a wire cushion located between the support tube and the guide tube.

* * * * *